US007849646B2

(12) United States Patent
Harinishi

(10) Patent No.: US 7,849,646 B2
(45) Date of Patent: Dec. 14, 2010

(54) GYMNASTIC FLOOR STRUCTURE

(75) Inventor: Atsushi Harinishi, Izumisano (JP)

(73) Assignee: NGC Corporation, Izumisano-shi (JP)

( * ) Notice: Subject to any disclaimer, the term of this patent is extended or adjusted under 35 U.S.C. 154(b) by 142 days.

(21) Appl. No.: 12/232,313

(22) Filed: Sep. 15, 2008

(65) Prior Publication Data

US 2009/0139172 A1 Jun. 4, 2009

(30) Foreign Application Priority Data

Sep. 18, 2007 (JP) ..... 2007-240445

(51) Int. Cl.
*E04F 15/22* (2006.01)
*A63C 19/00* (2006.01)

(52) U.S. Cl. ..... 52/403.1; 52/385; 52/309.4; 52/480; 52/506.06; 472/92; 248/633; 404/35; 404/36; 446/220

(58) Field of Classification Search ..... 52/506.01, 52/506.04, 506.06, 403.1, 480, 470, 582.1, 52/309.4, 309.8, 309.1, 384–385; 472/92; 248/633; 404/35, 36; 446/220
See application file for complete search history.

(56) References Cited

U.S. PATENT DOCUMENTS 3,828,503 A * 8/1974 Hofmann ..... 52/393
3,846,856 A * 11/1974 Tu ..... 5/420
4,648,592 A * 3/1987 Harinishi ..... 472/92
7,096,631 B1 * 8/2006 Counihan ..... 52/403.1
7,694,480 B2 * 4/2010 Niese et al. ..... 52/403.1
7,721,498 B2 * 5/2010 Kang et al. ..... 52/428

FOREIGN PATENT DOCUMENTS

CN 201099969 Y * 8/2008
JP 2004-081838 3/2004

* cited by examiner

*Primary Examiner*—Jeanette Chapman
(74) *Attorney, Agent, or Firm*—Edwards Angell Palmer & Dodge LLP

(57) ABSTRACT

A gymnastic floor structure includes an elastic collective floor substrate 30 having a given area formed by arranging a plurality of plywood unit floor panels 3 equipped with a plurality of elastically supporting leg members 2 provided on a bottom surface thereof on a floor surface of a building, and an elastic layer including a flat cushioning air mat 4 and a fiber mat 5 as essential structural elements provided on the floor substrate 30. The air mat 4 includes a linking body 41 in which a pair of textile inner sheets 41*a* and 41*b* are linked by a plurality of linking threads 43 and airtight external sheets 42 and 42*a* entirely covering the linking body 41, and has an airtight space 44 therein.

20 Claims, 9 Drawing Sheets

GYMNASTIC FLOOR STRUCTURE

This application claims priority to Japanese Patent Application No. 2007-240445 filed on Sep. 18, 2007, the entire disclosure of which is incorporated herein by reference in its entirety.

TECHNICAL FIELD

The present invention relates to an elastic floor structure mainly used for floor exercises for gymnastics. More specifically, it relates to an assembly type gymnastic floor structure in which unit floor panels each equipped with an elastically supporting leg member on its bottom surface are arranged on a floor of a structural body, such as, e.g., a gymnasium, and integrally joined with each other to thereby form a collective floor substrate rich in repulsive resilience on which a cushion sheet, a carpet, etc., is laid to form a performance surface of a predetermined area.

BACKGROUND ART

Conventionally, as this kind of gymnastic floor, the following floors as disclosed by the below-listed Patent Documents 1 and 2 are publicly-known and in practical use.

(Patent Document 1): Japanese Unexamined Laid-open Patent Publication No. 2004-81838

(Patent Document 2): U.S. Pat. No. 4,648,592

These gymnastic floors, typically, have the following structure.

As shown in FIGS. 11 and 12, a plurality of rigid unit floor panels 101, such as rectangular plywood panels, each equipped with a plurality of elastically supporting leg members 102 on its bottom surface, are arranged on a structural body floor surface F of a building in a matrix arrangement and integrally joined with each other to form a collective floor substrate of a predetermined area. On the upper surface of the floor substrate, an elastic layer 103 made of a single or stacked multiple layers 103*a* and 103*b* of resin foam are disposed. Furthermore, on the top surface of the elastic layer 103, a fiber mat 104, such as a cut pile carpet, is laid to thereby provide an elastic floor surface for gymnastics that exerts given strong elasticity against a vertical load.

DISCLOSURE OF THE INVENTION

Problems to be Solved by the Invention

In the gymnastic floor as shown in FIG. 11, as the main material of the elastically supporting leg member 102, a metal coil spring 102*a* is used. On the other hand, in the case of the floor as shown in FIG. 12, in place of the coil spring, a short columnar resin foamed member 102*b* which is a synthetic resin foamed member of a low foaming rate of 5 to 6 is used.

The gymnastic floor shown in FIG. 12 using the resin foamed member 102*b* as the elastically supporting leg member 102 is relatively light in weight, low in height, low in cost, and excellent in shock-absorbing performance, which has various advantages, such as, e.g., giving less loads to legs and/or arms of gymnasts, providing good landing stability, and also making less abnormal sounds during use. For these advantages, the floor has been widely used around the world.

In the case of the floor using resin foamed members 102*b*, however, as compared with the gymnastic floor as shown in FIG. 11 using elastically supporting leg members 102 of metal springs 102*a*, the floor has an essential characteristic that it is 20 to 30% inferior in repulsive resilience and spring power which will be exerted to gymnasts.

Recently, in various floor gymnastic performances, higher level techniques are frequently employed. Therefore, to jump higher to perform more difficult technique, there is a strong request from gymnasts that a floor further improved in springing characteristics be provided.

To cope with such demands, recently, in sports stadiums and practice arenas, spring-type gymnastic floors as shown in FIG. 11 using metal coil springs as elastically supporting leg members 102 are widely used.

However, there is a serious problem. It has been recognized for a long time, but a spring-type elastic floor is likely to exert too much repulsive resilience, which tends to cause continuous floor vibration at the time of the performer's landing. This not only gives discomfort to performers, but also gives a larger burden to performers' joints due to the vibration. Furthermore, the jiggly reactions and occurrence of a resonance of the spring may pose a problem to the accuracy of difficult combination performances performed by gymnasts.

Conventionally, in order to suppress the aforementioned floor vibration caused by springs, it has been attempted to increase the thickness of the cushioning material laminated on the substrate surface, i.e., the thickness of the foamed synthetic resin elastic layer. This approach has achieved a limited successful outcome. However, in order to effectively suppress the vibration, if the cushion layer is increased in thickness and a soft cushion having a small compression reactive force is used as the cushion layer, the so-called bounce becomes poor, making it harder for gymnasts to perform difficult performances. To the contrary, if the cushion layer is decreased in thickness and increased in hardness, there is such a dilemma that the vibration suppressing effects are reduced and the vibration suppression effect at the time of landing becomes poor, which increases the risk of injuries.

On the other hand, as mentioned above, the floor using elastically supporting leg members 102 of resin foamed members 102*b* has a characteristic that landing stability is better than that of the floor using metal springs 102*a*. Thus, depending on the gymnasts' age, gender, content of performances (type, difficulty, etc.), their skills, etc., the floor using resin foamed members 102*b* are still being used. In addition, since the proper value of the repulsive resilience differs depending on the gymnast's age, gender, content of performance, and skills, a floor capable of adjusting the repulsive resilience value is desired.

As described above, it is desired that a gymnastic floor has a variety of functions relating to repulsive resilience, vibration suppression, landing stability, and shock-absorbing properties depending on the situation where they are used.

Under the aforementioned technical background, the present invention aims to provide a gymnastic floor structure having excellent repulsive resilience which makes it easier for gymnasts to perform extremely difficult performances, and, at the same time, which is capable of effectively suppressing vibration at the time of the landing to improve the landing stability.

Furthermore, the present invention aims to provide a gymnastic floor excellent in sense of use, less likely to impose harmful effects or burden on the performer's body, and excellent in safety.

Furthermore, the present intention aims to provide a gymnastic floor with excellent versatility, which is capable of adjusting the repulsive resilience to an appropriate value depending on the gymnast's age, gender, content of the performance, skills, etc.

Means to Solve the Problems

To cope with the aforementioned purposes, in the present invention, improvements are made to a conventional elastic floor structure employing elastically supporting leg members.

The main improvements reside in that a cushion air mat of a special structure is equipped within a laminated cushion material to be laid on a collective floor substrate constituted by rigid unit floor panels made of, e.g., plywood panels having elastically supporting leg members fixed to its bottom surface.

The concrete structure of the present invention will be described below.

The gymnastic floor structure according to the present invention is characterized in that it includes, as its basic structural elements, a plurality of elastically supporting leg members to be arranged on a floor surface of a building at predefined intervals, a plurality of rigid unit floor panels supported by and laid on the plurality of elastically supporting leg members and integrally joined with each other, a cushioning air mat laid on the plurality of rigid unit floor panels, and a fiber mat laid on the air mat in a laminated manner. Furthermore, the cushioning air mat has a linking body having an air space between opposed surfaces of two inner sheets linked by a plurality of linking threads. The linking body is covered by a non-air permeable external sheet to form a mat main body which makes the space air-tight. Furthermore, the mat main body is provided with a closable air inlet/outlet port for supplying air into or discharging air from the space at a given position of the mat main body.

As the more preferable structure, a lower elastic layer formed by a synthetic resin foamed member is disposed between the rigid unit floor panel and the cushioning air mat.

Furthermore, an upper elastic layer formed by a synthetic resin foamed member is disposed between the cushioning air mat and the fiber mat.

Therefore, as the most preferable structure, the upper and lower elastic layers are disposed on and under the air mat respectively, so that the air mat is sandwiched by both the elastic layers.

General preferable concrete examples of each member are as follows.

As the elastically supporting leg member, a coil spring-type leg member or a synthetic resin foam-type leg member can be preferably employed.

The synthetic unit floor panel is a plywood panel. It is preferable that the plywood panel is a laminated panel in which a tensile resistance sheet member, especially a glass fiber cloth layer, is laminated to increase the strength.

The inner sheet of the cushioning air mat is a woven fabric, and the linking thread of the cushioning air mat is interwoven into the woven fabric. Furthermore, a density of the linking threads of the cushioning air mat is set to 1 to 5 pieces/cm$^2$.

The external sheet of the cushioning air mat is a stretch air-tight sheet, preferably made of urethane series resin.

The fiber mat is made of a cut pile carpet.

Furthermore, as the lower elastic layer, it is preferable to employ a layer formed by a synthetic resin foamed member which is 10 to 30 mm in thickness, 6.86 to 9.80N/cm$^2$ in 25% compression hardness (JIS K6767), and 50 to 60% in repulsive resilience (JIS K6301). As the lower elastic layer, it is preferable to employ a layer formed by a polyolefin resin foamed member or a rubber-modified ethylene vinyl acetate resin foamed member.

On the other hand, as the upper elastic layer, it is preferable to employ a layer formed by a synthetic resin foamed member which is 20 to 50 mm in thickness, 2.94 to 4.90 N/cm$^2$ in 25% compression hardness (JIS K6767), and 60 to 70% in repulsive resilience (JIS K6301). As the lower elastic layer, it is preferable to employ a layer formed by a polyolefin resin foamed member or a rubber-modified ethylene vinyl acetate resin (EVA) foamed member.

EFFECTS OF THE INVENTION

According to the gymnastic floor structure of the present invention, it exerts excellent repulsive resilience by the elastically supporting leg members arranged on the lower surface of the rigid unit floor panel. In addition, since the air mat is provided in the elastic layers laid on the surface of the unit floor panels, i.e., the collective floor substrate, the repulsive resilience of the air mat further exerts higher repulsive resilience. Therefore, the gymnasts can, jump higher, making it easier for the gymnasts to perform difficult performances.

Furthermore, the air mat has excellent vibration absorption function as one of its characteristics. Therefore, although the air mat has high repulsive resilience as mentioned above, the air mat prevents vibration of the elastically supporting leg members from reaching the upper performance surface, which enable to provide a performance surface with excellent sense of use when landing.

Also, the air mat is capable of controlling the repulsive resilience by adjusting the air pressure inside the mat main body, which enables to provide a floor surface having proper repulsive resilience depending on the gymnast's age, gender, content of the performance, the skill, etc. The air mat can re-create a desired repulsive resilience as many times as needed, so it is excellent in versatility as a gymnastic floor used by a variety of people.

Also, the air mat portion itself is light in weight, and it can be formed into a foldable compact member by discharging the air. Therefore, it is advantageous to transport and storage.

In cases where the lower elastic layer formed by a synthetic resin foamed member is disposed between the rigid unit floor panel and the cushioning air mat, the lower elastic layer protects the air mat and prevents the breakage of the air mat due to strong frictions caused by the contact to the lower side rigid unit floor panel and/or the joining members. Furthermore, the lower elastic layer enhances the repulsive resilience of the floor surface.

Furthermore, in cases where the upper elastic layer formed by a synthetic resin foamed member is disposed between the cushioning air mat and the upper fiber mat, the upper elastic layer covers and protects the air mat from the upper surface side thereof to prevent breakage of the air mat and occurrence of air leakage, and also retains extremely excellent repulsive resilience on the upper surface of the floor by the cooperative functions of the elasticity of the elastically supporting leg member, the air mat, and the lower elastic layer.

The preferable examples of each structural member have the following advantages.

By employing a coil spring-type supporting leg member or a synthetic resin foam-type supporting leg member as the elastically supporting leg member, a gymnastic floor can have different repulsive resilience according to the specific repulsive resilience of the supporting leg member. Also, repulsive resilience for the floor structure can be obtained from the cooperative functions of the elastically supporting leg members and the air mat, and the cooperative functions of the lower elastic layer and the upper elastic layer.

In the case of employing the coil spring-type supporting leg member as the elastically supporting leg member, a gymnastic floor would have especially excellent repulsive resilience due to the springs. Further, in combination with the repulsive resilience of the air mat, the high repulsive resilience will be enhanced. The gymnastic floor enables gymnasts who perform difficult performances to leap higher, making it easier to execute performances of high difficulty. In addition, the use of the air mat enhances the vibration absorption function. Therefore, while keeping the high repulsive resilience, vibration of the springs of the elastically supporting leg members will be prevented from reaching the upper side performance surface, which enables to provide a performance surface with an excellent sense of use when landing.

In the case of employing the synthetic resin foam-type supporting leg member as the elastically supporting leg member, although the repulsive resilience is smaller than that when the coil spring-type supporting leg member is employed, the gymnastic floor would have excellent landing stability. In addition, the repulsive resilience of the gymnastic floor can be increased by the air mat, and also by the lower elastic layer and the upper elastic layer, so repulsive resilience higher than that of the conventional gymnastic floor shown in FIG. 12 can be obtained.

In cases where the rigid unit floor panel is formed by a plywood panel, the floor can be made at a relatively lower cost and have excellent high impact resistance and durability.

In the case where the inner sheet of the air mat is formed by a woven fabric, the stretch of the external sheet can be restrained and the excellent flatness of the mat can be maintained. Furthermore, it is advantageous in weaving the linking threads. Also, in cases where the linking threads are interwoven into the woven fabric, strong binding force can be obtained.

In cases where the density of the linking threads is 1 to 5 pieces/$cm^2$, proper strength can be obtained.

In cases where the exterior sheet is made of urethane series resin, an air mat excellent in various characteristics, such as, e.g., elastic modulus, load bearing, mechanical strength, oil resistance, chemical resistance, and abrasion resistance, can be obtained.

In cases where a cut pile carpet is employed as the upper fiber mat, there is no threat of giving abrasion wounds to gymnasts, and it has an excellent sense of use and durability.

In cases where the lower elastic layer is a layer formed by a resin foamed member which is 10 to 30 mm in thickness, 6.86 to 9.80 N/$cm^2$ in 25% compression hardness (JIS K6767), and 50 to 60% in repulsive resilience (JIS K6301), and preferably formed by a polyolefin resin foamed member or a rubber-modified ethylene vinyl acetate resin foamed member, more preferably a rubber-modified ethylene vinyl acetate resin foamed member, a gymnastic floor with a sufficiently satisfactory level of repulsive resilience, sense of use, safety, and durability, can be obtained.

In cases where the upper elastic layer is a layer formed by a resin foamed member which is 20 to 50 mm in thickness, 2.94 to 4.90 N/$cm^2$ in 25% compression hardness (JIS K6767), and 60 to 70% in repulsive resilience (JIS K6301), and preferably formed by a polyolefin resin foamed member or a rubber-modified ethylene vinyl acetate resin foamed member, more preferably an ethylene vinyl acetate resin foamed member, the same advantages as mentioned above can be obtained.

BEST MODE FOR CARRYING OUT THE INVENTION

Hereinafter, embodiments of the present invention will be explained with reference to the attached drawings.

Figure 1:
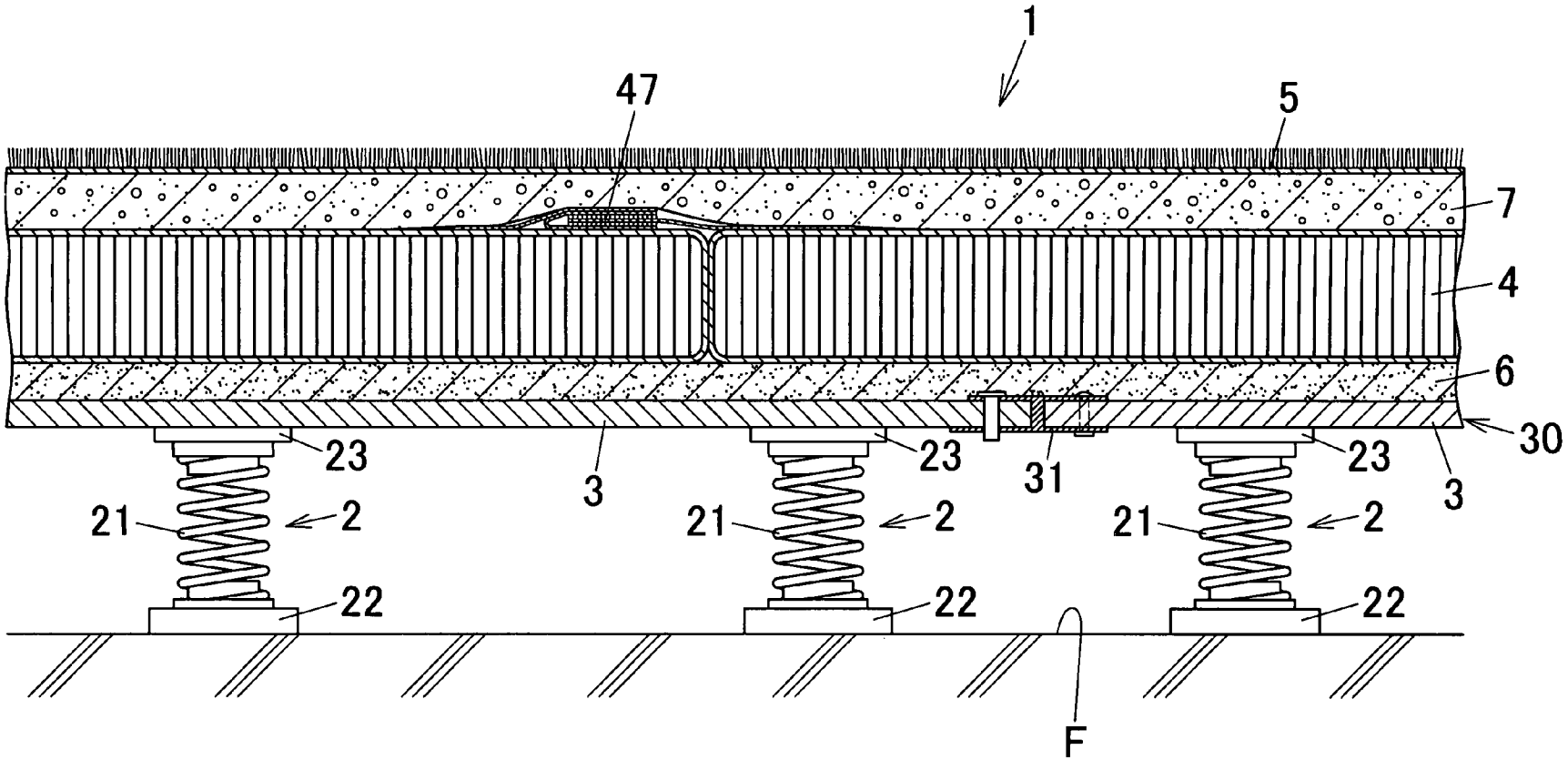
FIG. 1 is a cross-sectional view of a substantial part of a gymnastic floor structure according to a preferred embodiment of the present invention.
Figure 2:
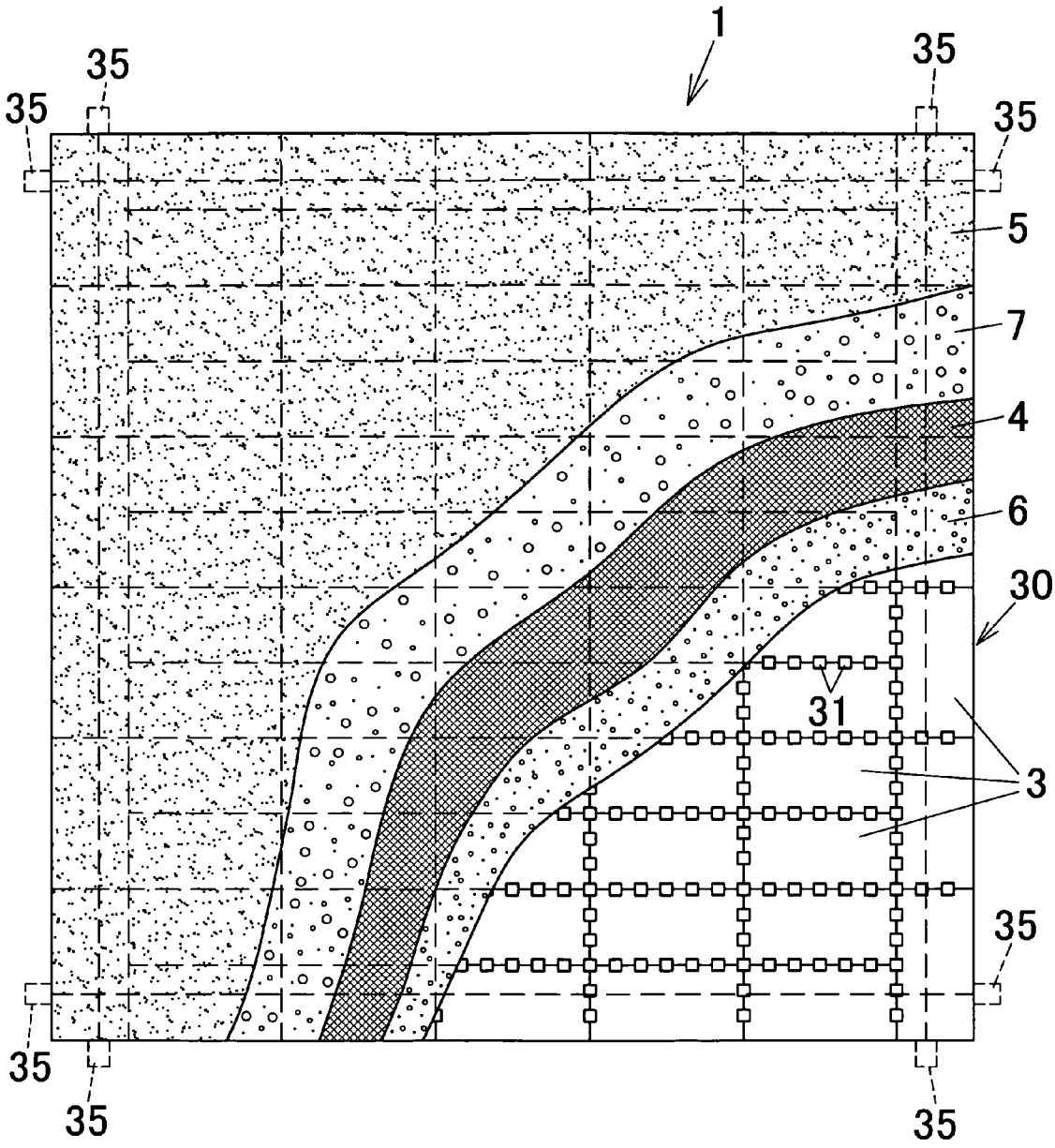
FIG. 2 is a partially cutout plan view showing the entire gymnastic floor structure.

FIG. 1 is a partial cross-sectional view showing the structure of a preferred embodiment of a gymnastic floor structure according to the present invention in an easily understandable manner, and FIG. 2 is a partially cut-out plan view showing the entire gymnastic floor structure as seen from the upper surface side in which the lower structural members are exposed. FIGS. 3 to 8 are enlarged exploded views each showing the substantial part of the gymnastic floor structure.

The gymnastic floor structure 1 according to the present invention is provided with, as its basic structural components, a number of elastic supporting leg members 2 to be disposed at certain intervals in a distributed manner on a floor surface F of a building frame of a building, such as, e.g., a gymnasium, a number of rigid unit floor panels 3 integrally joined with each other in a state in which the panels 3 are orderly disposed on the supporting leg members 2 lengthwise and crosswise with the panels 3 supported by the supporting leg members 2, a number of cushioning air mats 4 disposed on the surface of the collective floor substrate 30 formed by a collective of the unit floor panels 3, and a fiber mat 5 arranged on the upper surface.

Disposed between the unit floor panel 3 and the air mat 4 is a lower elastic layer 6. Disposed between the air mat 4 and the fiber mat 5 is an upper elastic layer 7.

The elastically supporting leg member 2 is a coil spring-type supporting leg member which includes a metal coil spring 21 as a main member. The lower end of the coil spring 21 is coupled to a rubber lower pedestal member 22 in a fitted manner, so that the lower surface of the pedestal member 22 is brought into contact with the floor surface F so as not to scratch the floor surface F. To the top surface of the coil spring 21, an upper cap member 23 of synthetic resin is attached. The upper cap member 23 is fixed to the lower surface of the unit floor panel 3 with a mounting screw 24 inserted in the center portion of the upper cap member 23 from the lower surface side thereof (See FIG. 5).

Figure 3:
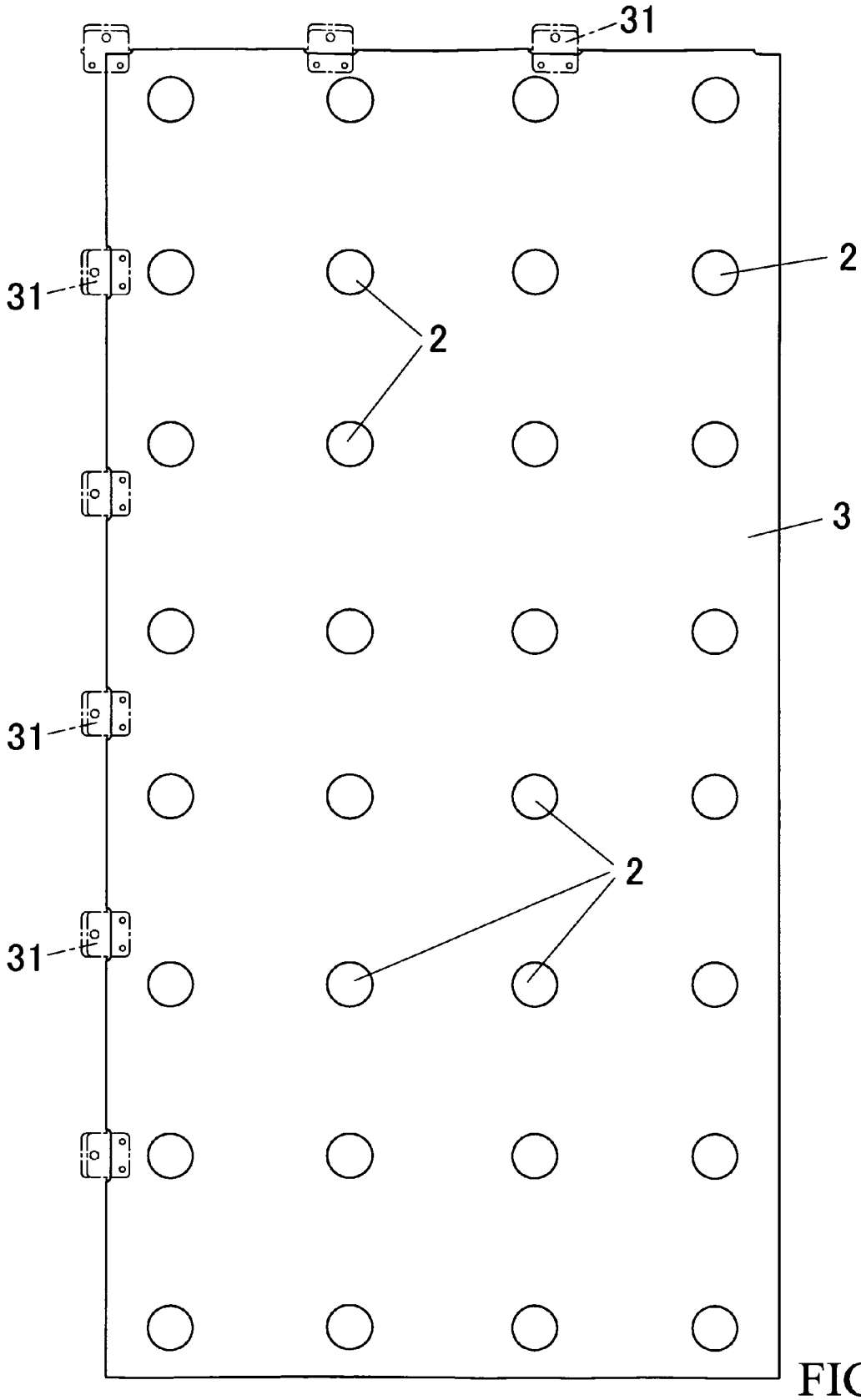
FIG. 3 is a bottom view of the unit floor panel equipped with elastically supporting leg members.

The installation density of the supporting leg members 2 is not especially limited. Typically, the density is set to about 12 to 16 pieces/$m^2$ in a placement manner as shown in FIG. 3.

The rigid unit floor panel 3 is, for example, a wooden plywood panel with width 1,200 mm×length 2,400 mm×thickness 14 mm. Preferably, in the middle portion of the lamination layers, as an extendable reinforcing layer, for example, a glass fiber cloth is laminated.

As shown in FIG. 2, a number of unit floor panels 3 are regularly arranged lengthwise and crosswise according to the required area for the gymnastic floor, and the adjacent panels 3 are integrally firmly joined with the side edge portions connected. For this connection, the unit floor panel 3 is equipped with joining members 31 at the peripheral edge thereof.

Figure 4:
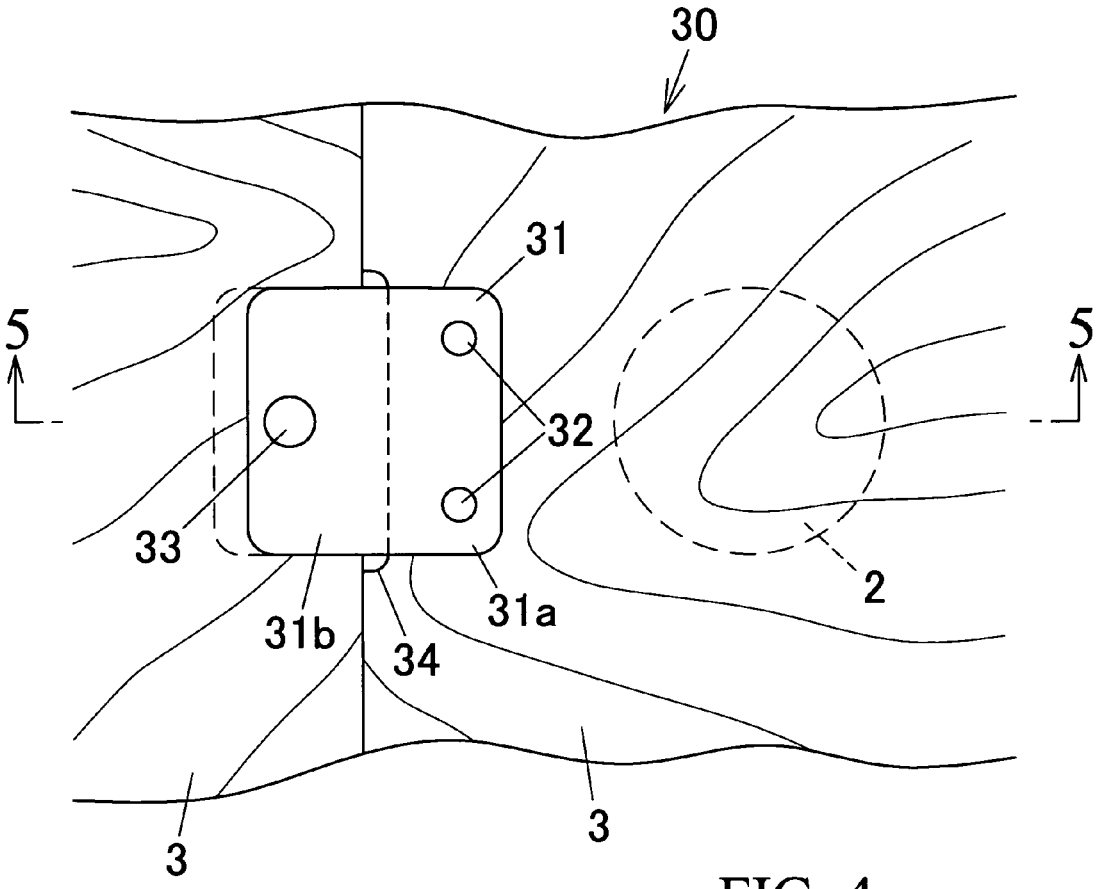
FIG. 4 is a plan view of a joined portion of unit floor panels.
Figure 5:
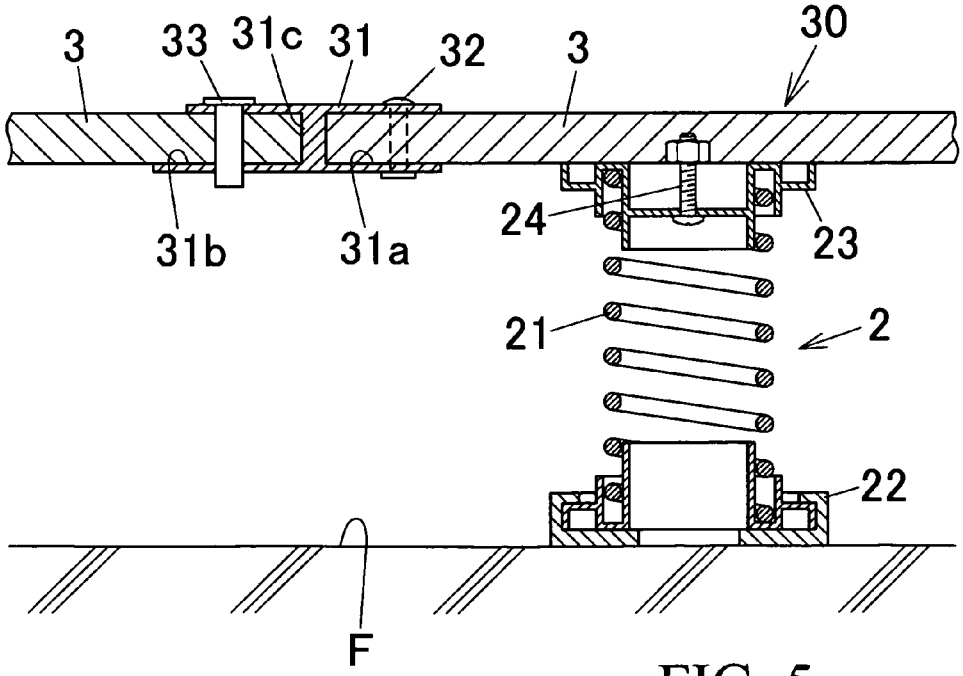
FIG. 5 is a cross-sectional view taken along the line 5-5 in FIG. 4.

The structure of the joined portions by the joining member 31 is shown in detail in FIGS. 4 and 5.

As shown in these drawings, the joining member 31 is a member having oppositely-oriented U-shaped fitting portions 31*a* and 31*b*, which is approximately "H" in cross-section. The side edge portion of one of adjacent unit floor panels 3 is fitted in one of the fitting portions 31*a* and fixed thereto with rivets 32, while the corresponding side edge portion of the other unit floor panel 3 is fitted in the other fitting portion 31*b* and detachably joined thereto with an insertion pin 33.

The joining member 31 is attached to the unit floor panels 3 in a state in which a vertical web portion 31*c* is fitted in a cutout portion 34 formed at one of side edges of adjacent unit floor panels 3 and 3 as shown in FIG. 4, so that no gap is formed between the adjacent unit floor panels 3 and 3.

Also, as shown in FIG. 3, the joining members 31 are attached to the unit floor panel 3 such that five joining members 31 are attached to the longer side of the two adjacent sides of the unit floor panel 3, two joining members 31 are attached to the shorter side with equal intervals, and one joining member 3 is attached to the corner portion of the unit floor panel 3.

A number of unit floor panels 3 and 3 are arranged and integrally joined with each other by the aforementioned joining members 31, so that a collective floor substrate 30 having a required area as shown in FIG. 2 is formed. This collective floor substrate 30 is formed into, for example, a square shape with 12 m sides. The fastening member 35 shown in FIG. 2 is configured to secure the four sides of the peripheral edge portions of the collective floor substrate 30 to prevent accidental separation of unit floor panels 3 and 3. One example of the specific structure is shown in, for example, the aforementioned Patent Document 2.

On the surface of the collective floor substrate 30, a covering elastic layer is provided. The covering elastic layer includes a cushioning air mat 4 and a fiber mat 5 as essential members. Preferably, the covering elastic layer further includes the abovementioned lower elastic layer 6 and upper elastic layer 7.

Figure 6:
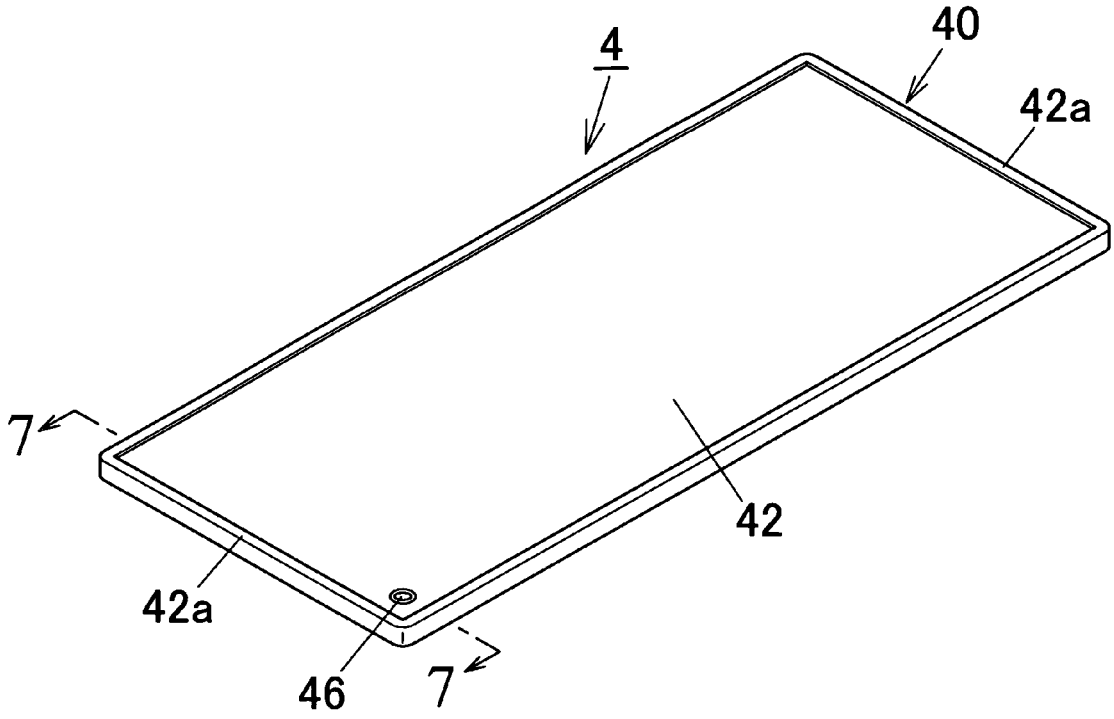
FIG. 6 is a perspective view of a cushioning air mat.
Figure 7:
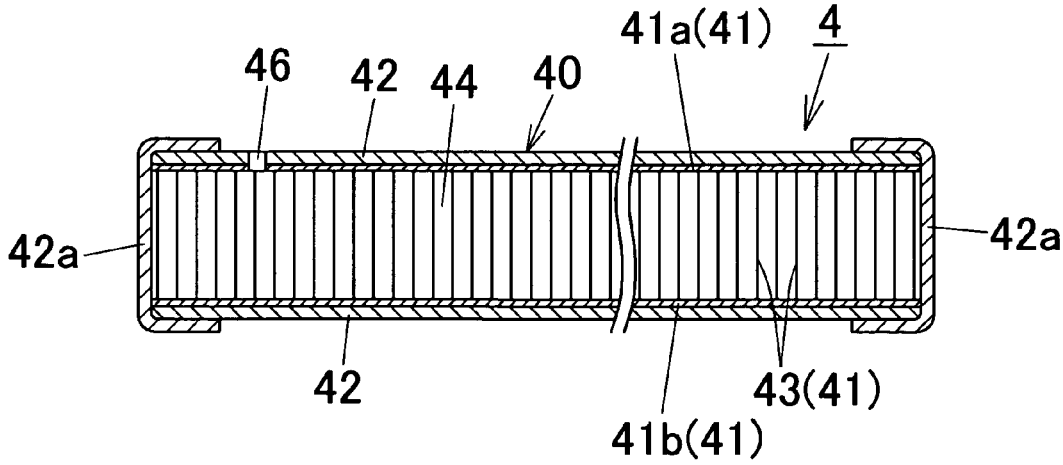
FIG. 7 is a cross-sectional view taken along the line 7-7 in FIG. 6 in which a part of the intermediate portion is omitted.
Figure 8:
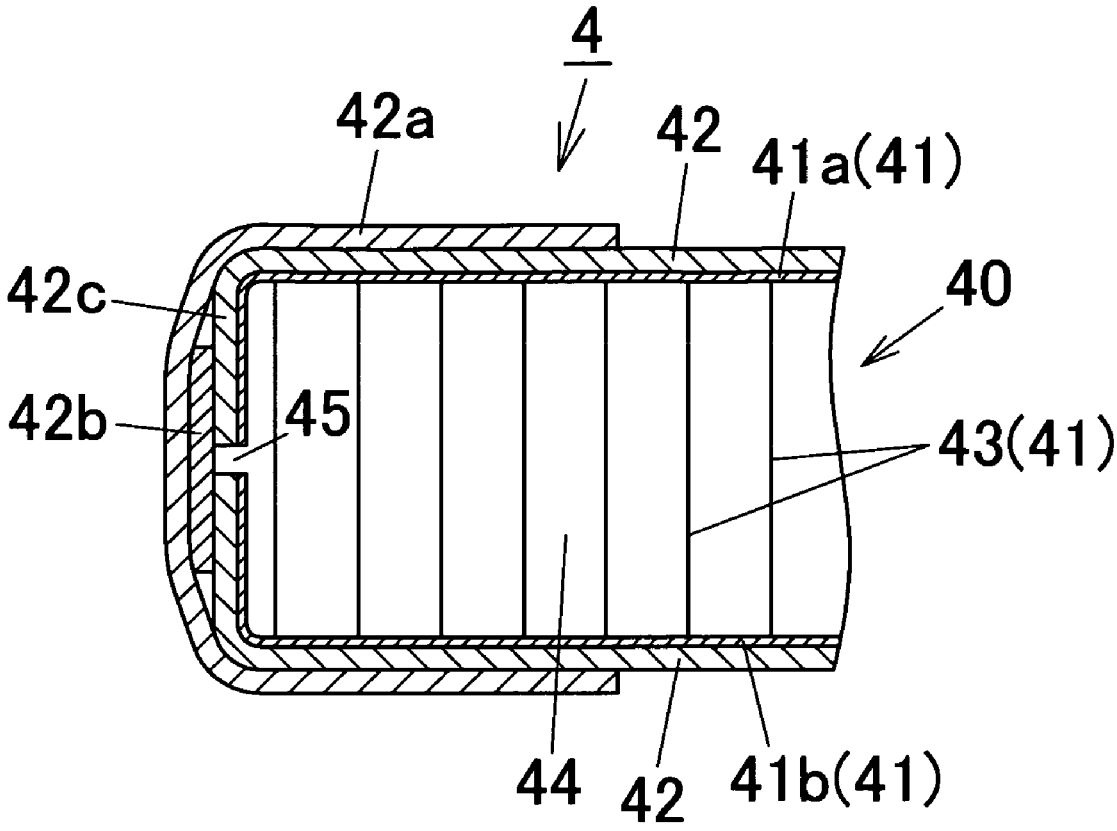
FIG. 8 is a cross-sectional view of the edge portion of the cushioning air mat.

The air mat 4 has repulsive resilience by the compressed air filled in the airtight mat main body 40 so that the air mat 4 absorbs vibration and reduces impact. An example of the concrete structure is shown in FIGS. 6 to 8.

The mat main body 40 includes a linking body 41 that determines the planar size and thickness of the mat and an external sheet 42 that covers the linking body 41 to retain the air-tightness and the strength.

The linking body 41 includes two inner sheets 41*a* and 41*b* made of a rectangular woven fabric having a size corresponding to the planar size of the mat and a number of linking threads 43 of a given length that link the opposed sides of the inner sheets 41*a* and 41*b*. The linking thread 43 is a part of weaving yarns drawn from one of the inner sheets 41*a*, interwoven into the other inner sheet 41*b* as its weaving yarn, drawn from the other inner sheet 41*b*, and again interwoven into the one of the inner sheets 41*a*. The drawing and weaving of the weaving yeans are repeated across the entire surface of the inner sheet 41*a* and 41*b* so that two inner sheets 41*a* and 41*b* are linked in an opposed state with a distance corresponding to the length of the linking thread 43. Thus, an air space 44 is formed in the linking body 41. The length of the linking thread 43 specifies the thickness of the air space 44, which in turn specifies the thickness of the mat main body 40.

The inner sheets 41*a* and 41*b* are configured to specify the planar size of the mat and hold the linking threads 43 as well, so any sheet can be used as long as it has these functions. The inner sheets 41*a* and 41*b* are covered and reinforced by the external sheet 42 described later, so they are not required to have strength and/or linking thread retaining force that can withstand the inner pressure of the mat by themselves. Consequently, even if the woven fabric forming the inner sheets 41*a* and 41*b* is thin and rough in texture, it can be sufficiently used. Other than various types of woven fabrics, the fabric can be, for example, a knitted fabric or a non-woven fabric. Among other things, it is recommended to use a woven fabric which is capable of restraining stretching of the external sheet 42 due to the inner pressure of the mat main body 40 to maintain the flatness of the mat and also advantageous in weaving a number of linking threads 43.

The linking threads 43 are configured to regulate the thickness of the space 44, which is a distance between two inner sheets 41*a* and 41*a*, in a state in which tension is applied to the linking threads 43 by the inner pressure. Therefore, in order to secure the uniform thickness of the mat main body 40, it is preferable that the linking threads 43 exist in the entire area of the inner sheet 41*a* and 41*b* evenly. It is preferable that the density of the linking threads 43 falls within the range of 1 to 5 pieces/cm$^2$. If the density is lower than the aforementioned range, it is difficult to uniform the thickness and maintain the strength against the inner pressure. On the other hand, even if the density exceeds the abovementioned range, the number of steps for manufacturing the linking body 41 merely increases with no extra effects. The more preferable density of the linking threads 43 is 2 to 3 pieces/cm$^2$. In addition, in this embodiment, the linking threads 43 are interwoven into the inner sheets 41*a* and 41*b* so that the linking threads 43 are firmly interlinked with the inner sheets 41*a* and 41*b*. However, the linking threads 43 can be simply stitched into the sheets. The length of the linking thread 43 can be freely set in accordance with the given mat thickness. Furthermore, although a number of linking threads 43 can be arranged in parallel as shown in FIG. 7, they can also be arranged in a crossed manner between the inner sheets 41*a* and 41*b*.

In the linking body 41, the materials for the inner sheets 41*a* and 41*b* and the linking thread 43 are not specifically limited, but can be natural fiber or synthetic fiber, such as, e.g., cotton, rayon, nylon, polyester, and polypropylene. Also, the inner sheets 41*a* and 41*b* and the linking thread 43 can be made of the same or different fiber.

The linking body 41 is entirely covered by the non-air permeable upper and lower external sheets 42 and 42 and side external sheet 42*a* in an air-tight manner, so that the mat main body 40 having an air-tight space 44 therein is formed.

The upper and lower external sheets 42 and 42 are formed to have the same size as the inner sheets 41*a* and 41*b*, and joined to each of the entire outer surfaces of the inner sheets 41*a* and 41*b*. On the other hand, the side external sheet 42*a* is formed into a tape-like shape having a width wider than the thickness of the linking body 41, and surrounds the side surface of the linking body 41 with both widthwise sides thereof joined to the peripheral edge portions of the upper and lower external sheets 42 and 42 to thereby cover the four side surfaces of the linking body 41. Consequently, the upper and lower surfaces and the four side surfaces of the linking body 41 are all covered in an air-tight manner, so that the mat main body 40 having a space 44 therein is formed.

It should be noted that it is not required to conform the size of the inner sheet 41*a* and 41*b* and that of the upper and lower external sheet 42 to the planner size of the mat. For example, as shown in FIG. 8, it can be configured such that each size is set to be slightly larger than the planner size of the mat and the peripheral edge portion 42*c* is extended to the side surface portion. This reinforces the side surface portion of the mat 4.

The upper and lower external sheet 42 and the side external sheet 42*a* are non-air permeable, and has strength that can withstand the impact and/or the inner pressure due to the gymnast's landing. Also they are formed by the materials having flexibility capable of being freely folded. Specifically, sheets made of synthetic resin, such as, e.g., vinyl chloride series resin, olefin series resin, and urethane series resin, can be exemplified. Among other things, urethane series resin is recommended from the viewpoint that it is excellent in elastic modulus, load bearing, mechanical strength, oil resistance, chemical resistance and abrasion resistance. Among urethane series resins, polyurethane elastomer excellent in elastic modulus is especially recommended. Also, for the purpose of improving the sheet's characteristics, such as, e.g., strength, it can be allowed to mix various types of fillers. The thickness of the sheet 42 and 42*a* is preferably between 0.3 to 1.5 mm from the viewpoint of satisfying both the strength and the light-weight.

The joining of the upper and lower external sheet 42 and the side external sheet 42*a* is performed by a method that can attain air tightness, such as, e.g., pressure bonding, welding, or adhesive boding using adhesive agent. In the case of joining to the inner sheets 41*a* and 41*b*, synthetic resin to which fluidity is given can be applied to the inner sheets 41*a* and 41*b* and then solidified to form a sheet. Since the joint portion of the two inner sheets tends to easily loose the air-tightness, it is also preferable to maintain the air-tightness by doubly attaching external sheets as shown in FIG. 8. In the illustrated example, a narrow-width auxiliary external sheet 42*b* is adhered to the joint portion 45, and on top of that, a wide-width side external sheet 42*a* is adhered.

Furthermore, at the vicinity of the corner portion of the upper surface of the mat main body 40, as shown in FIG. 6, an air inlet/outlet port 46 which penetrates the external sheet 42 and the inner sheet 41*a* and is closable in an airtight manner by a lid or a bulb and the like (not illustrated) is provided. The air inlet/outlet port 46 is detachably connected to an air supply pump (not illustrated), so that air is supplied into and discharged from the space 44 of the mat main body 40 via the inlet/outlet port 46. It is acceptable to provide the inlet/outlet port 46 at a single portion, but it is preferable to provide the inlet/outlet ports at two or more portions to attain quicker air supply and discharge. The number of the air inlet/outlet ports 46 can be set arbitrarily depending on the size of the air mat 4. Furthermore, the installation position is not limited, and the air inlet/outlet ports can be provided at any positions of the upper and lower surface and the side surface of the mat. FIG. 6 shows an example in which the air inlet/outlet port 46 is provided at the upper surface of the air mat. In the case of arranging a plurality of air mats 4, it is preferable to provide the air inlet/outlet ports at the side surface for easy air supplying/discharging operations.

In the aforementioned cushioning air mat 4, when compressed air is supplied into the space 44 of the mat main body 40 through the air inlet/outlet port 46, the two inner sheets 41*a* and 41*b* will be separated to a distance corresponding to the length of the linking thread 43, so that the mat main body 40 becomes uniform in thickness. When air is supplied further, since the separation distance of the inner sheets 41*a* and 41*b* is controlled by the linking threads 43, the tension on the linking threads 43 increases and the air pressure also increases with the constant thickness maintained. Since the air pressure is reflected in the repulsive resilience, the repulsive resilience of the mat can be freely controlled by setting the air pressure. In addition, as long as the air-tightness of the mat main body 40 is not lost, the desired repulsive resilience can be reproduced any number of times.

The desired number of air mats 4 are arranged and laid to cover the entire surface of the collective floor substrate 30 as shown as shown in FIG. 2. At this time, as shown in FIG. 1, the adjacent air mats 4 and 4 are joined so as not to separate using a hook-and-loop faster joining member 47 provided at respective side edge portions.

It is preferable that a branch pipe communicated with each inlet/outlet port 46 is connected to a plurality of air mats 4. By connecting an air supply pump to the branch pipe, it is possible to simultaneously supply air to the plurality of air mats 4 with less number of pumps than the air mats, resulting in efficient air supply. Furthermore, since a plurality of air mats 4 are connected each other via the branch pipe, it is easy to equalize the air pressure of the plurality of air mats 4. In cases where the air mats 4 are arranged such that the inlet/outlet ports 46 are arranged at one side of the floor structure, the length of the branch pipe can be minimized, reducing the pressure loss, which in turn enables efficient air supply. To perform prompt air supply, it can be configured such that a plurality of inlet/outlet ports 46 are provided at a single air mat 4 so that simultaneous air supply can be performed through a plurality of pipes. In the case of forming the inlet/outlet port 46 at the side surface of the air mat 4, the diameter of the port is limited, which prevents increasing of the air supplying speed by enlarging the diameter of the port. Therefore, it is preferable to employ the aforementioned method or the like to attain effective air supply.

The air mat 4 is set within the range of 30 to 100 mm in thickness in a state in which the air mat 4 is inflated by compressed air filled in the space 44 as mentioned above. It is more preferable that the thickness is set within the range of 50 to 80 mm. If the air mat 4 is too thick, there is a tendency that the repulsive resilience becomes too large, and the performance surface also easily shifts sideways when kicked by a gymnast from obliquely upward. This may increases unstable factors, making it harder for a gymnast to execute performances. In addition, the landing stability can also be decreased. To the contrary, if the air mat 4 is too thin, the vibration suppressing effect and the repulsive force become insufficient, and therefore it is not preferable.

The air pressure of the inside of the air mat 4 is set within the range of 10 to 30 kPa.

The proper value of the repulsive resilience of the air mat differs depending on the gymnast's age and practice contents. The examples of the proper value of the repulsive resilience can be shown in air pressure as follows: 10.3 kPa (1.5 psi) for infants' gym mat, 12.4 kPa (1.8 psi) for elementary school students' gym mat, 13.8 kPa (2.0 psi) for junior girls competitors' tumbling practice mat, and 27.6 kPa (4.0 psi) for men's competitors' tumbling practice mat.

On the other hand, when the air in the mat main body 40 is discharged, the tension on the linking threads 43 is lost to cause loose linking threads. As a result, the restraint of the separation distance of the inner sheets 41*a* and 41*b* is released and the repulsive resilience also disappears. This enables folding of the mat 4. Consequently, the transporting can be done easily and the storing space can be reduced.

The lower elastic layer 6 is directly laid on the collective floor substrate 30 so as to cover it and disposed between the collective floor substrate 30 and the air mat 4.

The lower elastic layer 6 compensates for the repulsive resilience of the floor and also prevents damage of the lower surface of the air mat 4 due to the frictional contacts with the rigid unit floor panel 3 and/or the joining member 31, and is formed by a synthetic resin foam sheet.

The preferable thickness of this lower elastic layer 6 is within the range of 10 to 30 mm. The more preferable range is between about 15 to 25 mm. If it is too thick, there is a tendency that the repulsive resilience gets too strong. If it is too thin, it is difficult to obtain sufficient repulsive resilience.

Also, the preferred physical property values are preferably set as follow to comprehensively satisfy the required properties, such as, e.g., repulsive resilience, vibration suppression, and landing stability. That is, it is preferable to use the material which is 6.86 to 9.80 N/cm$^2$ (0.7 kfg/cm$^2$ to 1.0 kgf/cm$^2$) in 25% compression hardness according to JIS K6767 and 50 to 60% in repulsive resilience according to JIS K6301. As such material that easily satisfies these physical properties, for example, a synthetic resin foamed member 5 to 6 times in foaming rate can be exemplified. More specifically, it is recommended to use a polyolefin resin foamed member or a rubber-modified ethylene-vinyl acetate resin foamed member, more preferably a rubber-modified ethylene vinyl acetate resin foamed member.

On the other hand, the upper elastic layer 7 strongly controls the properties of the surface portion of the floor. Particularly, depending on the upper elastic layer 7, there is a tendency that the quality of the spring of the floor and the quality of the landing stability are largely influenced.

The upper elastic layer 7 is also formed by an elastic synthetic resin foamed sheet. The preferable thickness is comparatively thicker than that of the lower elastic layer 6, or 20 to 50 mm. It is especially preferable that the thickness is about 30 to 40 mm. If it is too thick, there is a tendency that the repulsive resilience of the floor surface becomes poor. To the contrary, if it is too thin, it becomes more difficult to obtain good landing stability. If it is thicker, although the impact absorption is increased, there is a tendency that it becomes softer, causing decreased repulsion force when kicking the floor surface.

According to the results obtained from many actual tests by players, the preferred physical properties of the upper elastic layer 7 are as follows.

It is preferable to use an upper elastic layer having physical property values of 2.94 to 4.90 N/cm$^2$ in 25% compression hardness according to JIS K6767, and 60 to 70% in repulsive resilience according to JIS K6301. As such a material that easily satisfies these properties, for example, a synthetic resin foamed member can be exemplified. It is recommended to use a polyolefin resin foamed member or an ethylene-vinyl acetate resin (EVA) foamed member. Among other things, it is recommended to use an ethylene-vinyl acetate resin (EVA) foamed member.

The synthetic resin foamed member forming the lower elastic layer 6 and upper elastic layer 7 is not limited to the aforementioned one, and can be anything having desired physical property values.

The fiber mat 5 laid on the upper most surface comes into direct contact with the gymnast's feet bottom and determines the quality of the feel. At the same time, it reduces dangers of abrasion wounds on gymnast's legs and/or arms. Specifically, in general, a pile carpet, a tarpaulin cover, a needle punched carpet, etc., can be used. More preferably, a cut pile carpet is used.

As to the gymnastic floor structure 1, as a result of trial uses by a plurality of gymnasts, the following constitutional examples were determined to be preferable when used for floor exercises for senior men's gymnastics competition.

Constitutional Example 1

Lower Elastic Layer

Material: Ethylene acetate resin low foam (foaming rate: about 5 times) denaturalized by ethylene propylene rubber or butadiene rubber Thickness: 20 mm 25% compression hardness (JIS K6767): 7.94 N/cm$^2$ (0.81 kgf/cm$^2$)

Repulsive resilience (JIS K6301): 55%

Air Mat

Thickness: 70 mm

Air pressure: 27.6 kPa (4.0 psi)

Upper Elastic Layer

Material: Ethylene vinyl acetate resin foam (foaming rate: about 15 times)

Thickness: 30 mm

25% compression hardness (JIS K6767): 4.0 N/cm$^2$ (0.41 kgf/cm$^2$)

Repulsive resilience (JIS K6301): 65%

Constitutional Example 2

The lower elastic layer 6 and the upper elastic layer 7 were the same as those used in Constitutional Example 1.

Lower elastic layer: thickness 20 mm

Air mat: Thickness 70 mm; air pressure: 20.7 kPa (3.0 psi)

Upper elastic layer: thickness 30 mm

Constitutional Example 3

The lower elastic layer 6 was the same as the one used in Constitutional Example 1, and different in thickness from the upper elastic layer 7 used in Constitutional Example 1.

Lower elastic layer: thickness 20 mm

Air mat: thickness 70 mm; air pressure 27.6 kPa (4.0 psi)

Upper elastic layer: thickness 40 mm

In the comparison of the Constitutional Example 1 and Constitutional Example 3, in the case where the air pressure of the air mat 4 was set to 27.6 kPa (4.0 psi), a result was obtained that the balance of the spring (repulsive resilience) and the landing stability was better when the thickness of the upper elastic layer 7 was set to 30 mm (Constitutional Example 1) rather than 40 mm (Constitutional Example 3). Also, in the case where the air pressure of the air mat 4 was set to 20.7 kPa (3.0 psi), a result was obtained that the balance of the spring (repulsive resilience) and the landing stability was better when the thickness of the upper elastic layer 7 was set to 30 mm (Constitutional Example 2) rather than 20 mm or 40 mm.

Figure 11:
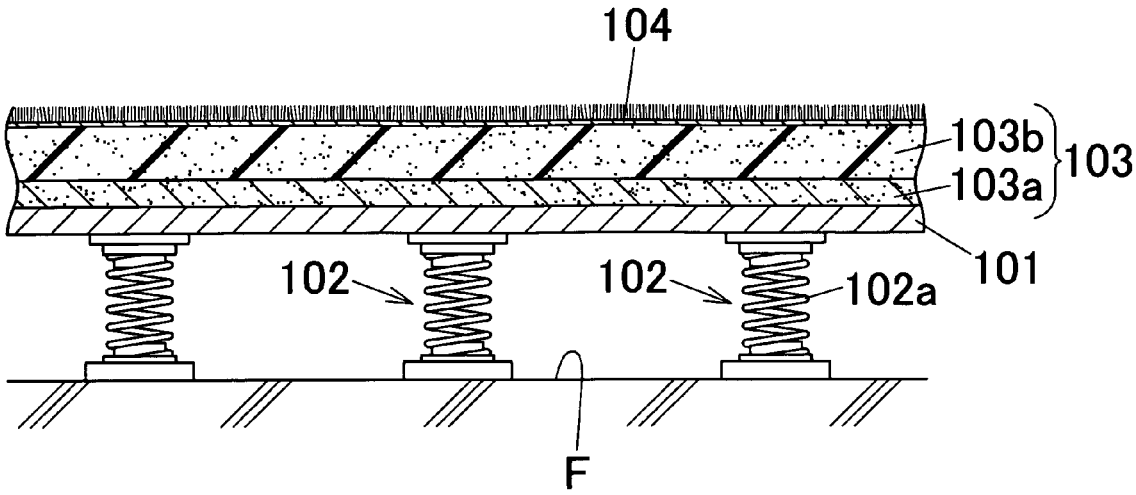
FIG. 11 is a partial cross-sectional view of a conventional gymnastic floor structure employing springs as elastically supporting leg members.

Furthermore, the gymnastic floor structure 1 of Constitutional Example 2 wherein the air pressure of the air mat 4 was set to 27.6 kPa (3.0 psi) was compared to the conventional floor structure using a metal coil spring 102*a* as the elastically supporting leg member 102 of FIG. 11. The compared conventional floor structure has the structure in which, on the floor panel 101 to which the coil spring 102*a* was attached, an ethylene-vinyl acetate resin low foamed member 103*a* (foaming rate: about 5 times) modified by ethylene propylene rubber and butadiene rubber having a thickness of 20 mm, an ethylene-vinyl acetate resin foamed member 103*b* (foaming rate: about 15 times) having a thickness of 40 mm and a fiber mat 104 are laminated. This conventional lamination structure is identical to the aforementioned Constitutional Example 3 from which the air mat 4 was removed. When a plurality of gymnasts experimentally used these two types of floor structures, the obtained result was that the gymnastic floor structure 1 of Constitutional Example 2 had 20% more spring (repulsive resilience) than the conventional floor structure that does not use the air mat.

Figure 9:
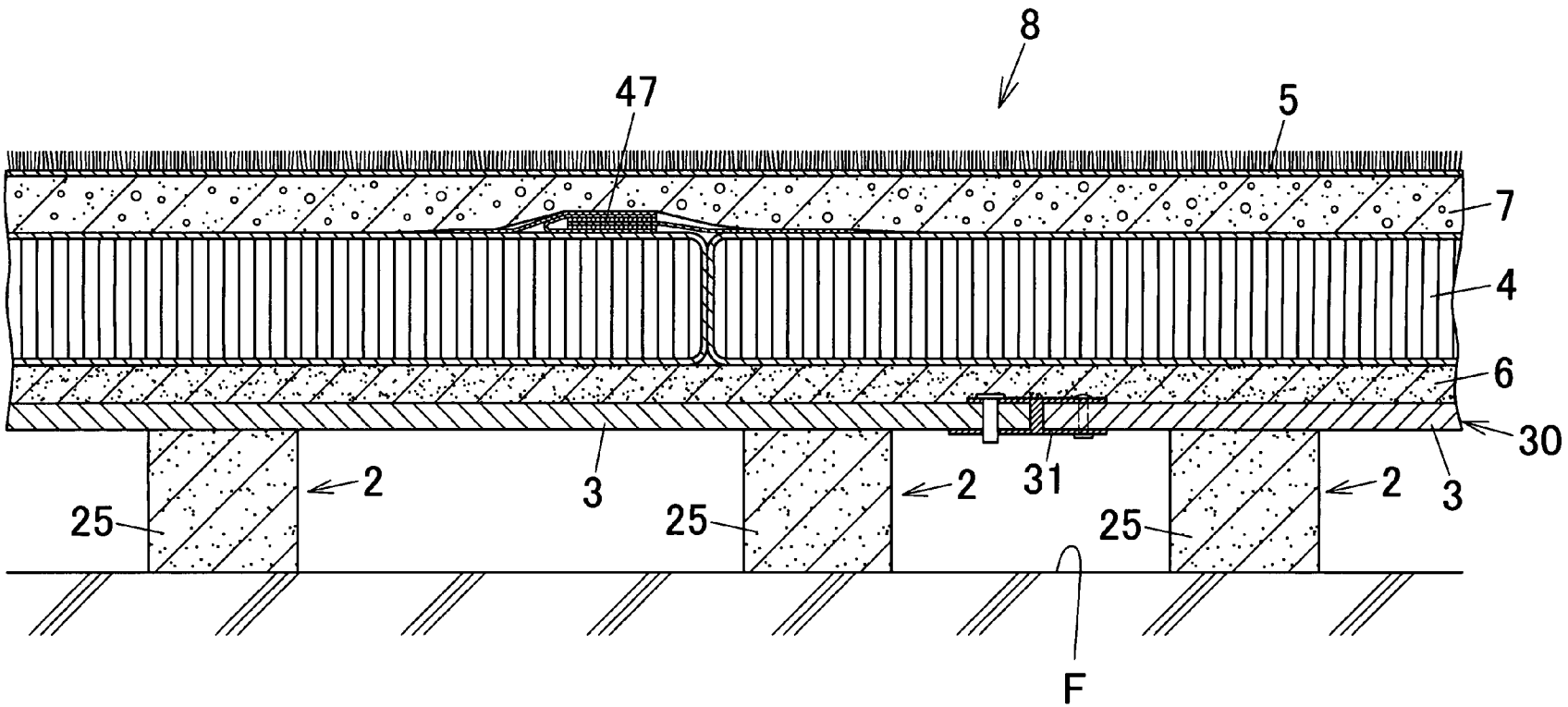
FIG. 9 is a cross-sectional view of a substantial portion of another embodiment of the present invention.

The gymnastic floor structure 8 shown in FIG. 9 uses a rectangular columnar shaped synthetic resin foamed member 25 which is 4 cm in length, 4 cm in width and 6 cm in height as the elastically supporting leg member 2. The resin foamed member 25 is fixed to the back side of the unit floor panel with adhesive agent. The gymnastic floor structure 8 has the same lamination structure as the gymnastic floor structure 1 shown in FIG. 1 except that synthetic resin foam type supporting leg member is used as the elastically supporting leg member 2. In FIG. 9, the same symbols as those in FIGS. 1 to 8 denote identical members.

Figure 12:
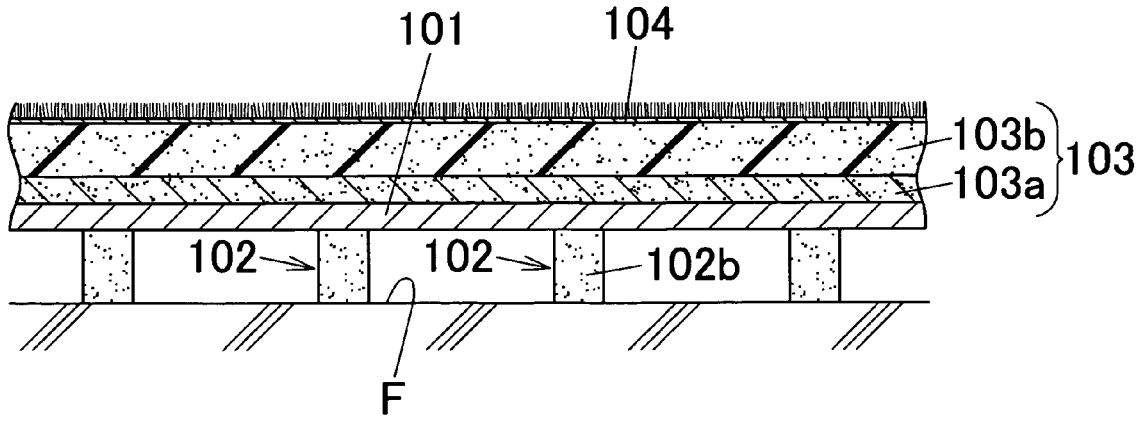
FIG. 12 is a partial cross-sectional view of a conventional gymnastic floor structure employing synthetic resin foamed members as elastically supporting leg members.

The synthetic resin foamed member 25 cannot obtain strong repulsive resilience and spring force like the coil spring 21 from itself, but has a characteristic excellent in landing stability. The repulsive resilience and the spring force of the entire floor structure can be increased by adjusting the thickness of the air mat 4 and the inside air pressure, and also can be adjusted by combining the lower elastic layer 6 and the upper elastic layer 7 different in properties and thickness. Therefore, even in the gymnastic floor structure using synthetic resin foam type supporting leg members, it is possible to increase the repulsive resilience and adjust the repulsive resilience. Also, by using the air mat 4, it is needless to say that the repulsive resilience can be increased than the conventional gymnastic floor shown in FIG. 12 in which an elastic layer 103 formed by a synthetic resin foam sheet is laid on the floor substrate 101. Furthermore, it is possible to increase the repulsive resilience than the gymnastic floor shown in FIG. 11 using a metal spring 102*a* as the elastically supporting leg member 102. As explained in the section of PROBLEMS TO BE SOLVED BY THE INVENTION, the floor (shown in FIG. 12) that uses a resin foamed member 102*b* as the elastically supporting leg member 102 has 20 to 30% less repulsive resilience than the floor (FIG. 11) using a metal spring 102*a*. This shows that the use of the air mat 4 can improve the repulsive resilience of the floor structure by 20 to 30% or more.

As the synthetic resin foamed member 25, for example, an ethylene-vinyl acetate resin (EVA) foamed member, a rubber-modified polyolefin foamed member, a rubber-modified ethylene propylene or butadiene rubber-modified ethylene-vinyl acetate resin (EVA) foamed member, with a foaming rate of 5 to 20 times, more preferably 5 to 15 times, and repulsive resilience of 50 to 60%, can be exemplified. As the more preferable synthetic resin foamed member 25, an ethylene-vinyl acetate resin (EVA) foamed member with a foaming rate of about 15 times can be recommended. The synthetic resin foamed member tends to have higher repulsive resilience with higher foaming factor, but at the same time, its durability tends to be deteriorated. Therefore, the synthetic resin foamed member to be used as the elastically supporting leg member can be chosen by considering the appropriate repulsive resilience and durability. Also, the height, the cross-sectional area, and the number of the synthetic resin foamed member can be set arbitrarily.

In the gymnastic floor structure 8, according to the results of the test use by a plurality of gymnasts, the most preferable constitutional example for use in senior men's gymnastic floor exercise is as follows. The lower elastic layer 6 and the upper elastic layer 7 were the same as those used in Constitutional Example 1.

Constitutional Example 4

The lower elastic layer: thickness 20 mm
Air mat: thickness 70 mm, air pressure 20.7 kPa (3.0 psi)
The upper elastic layer: thickness 30 mm In the case where the air pressure of the air mat 4 was set to 20.7 kPa (3.0 psi), according to the results obtained, the upper elastic layer 7 having a thickness of 30 mm (Constitutional Example 4) was better in landing stability and spring force than layers having a thickness of 20 mm and 40 mm.

Furthermore, the gymnastic floor structure 8 of the Constitutional Example 4 was compared to the conventional floor structure using the metal coil spring 102*a* as the elastically supporting leg member 102 shown FIG. 11. In the compared conventional floor structure, on the floor panel 101 on which the coil spring 102*a* was attached, an ethylene-vinyl acetate resin foamed member 103*a* (foaming rate: about 5 times) having a thickness of 20 mm denaturalized by ethylene propylene rubber and butadiene rubber, an ethylene-vinyl acetate resin foamed member 103*b* (foaming rate: about 15 times) having a thickness of 40 mm, and a fiber mat 104 were laminated. This conventional lamination structure was identical to the aforementioned Constitutional Example 3 from which the air mat 4 was removed. These two types of floor structures were experimentally used by a plurality of gymnasts. The obtained result indicated that the gymnastic floor structure 8 of Constitutional Example 4 was higher in spring force (repulsive resilience) by 10 to 20% than the floor structure using the conventional coil spring 102*a*. The landing stability was approximately equivalent.

The combination of each layer shown in the aforementioned Constitutional Examples 1 to 4 is examples with preferable results when the floor was used for senior men's gymnastic floor exercise. A floor structure preferable for individual gymnasts and contents of skills can be made by changing the thickness of each layer and the air pressure of the air mat.

As described above, in the aforementioned gymnastic floor structure 1 and 8, various repulsive resilience and spring forces can be obtained by selecting and combining the types of elastically supporting leg member 2, the thickness and air pressure of the air mat 4, and the material properties and the thickness of the lower elastic layer 6 and upper elastic layer 7. Especially, by using the air mat 4, the floor high in repulsive resilience and excellent in vibration absorption can be obtained, which is preferably used for high level performances and excellent in usability. Furthermore, the high shock-absorbing characteristics of the air mat 4 lessen the strain on joints, such as, legs, ankles, wrists, and knees. Since the strain on the body is reduced, injuries can be avoided, and fatigue can be alleviated. The alleviation of fatigue enables to increase the amount of practice and also contributes to technical improvements. Furthermore, according to the gymnasts' age, gender, content of the skills, and techniques, the repulsive resilience can be adjusted to the appropriate values and reproduced repeatedly, so it has excellent versatility for a gymnastic floor used by a variety of people.

Figure 10:
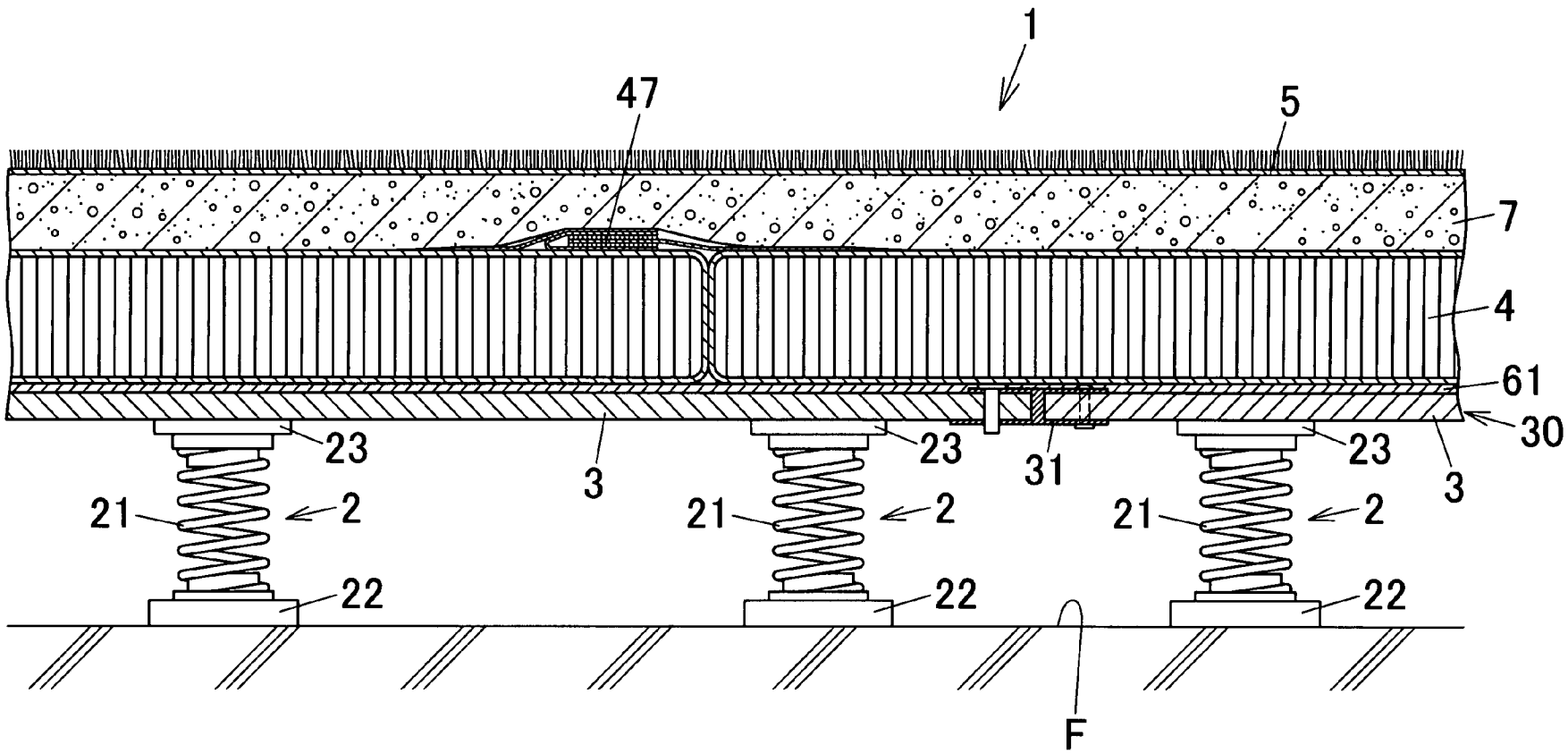
FIG. 10 is a cross-sectional view of a substantial portion of still another embodiment of the present invention.

FIGS. 1 to 9 show the most preferable embodiments of the floor structure of the present invention as explained above, but the present invention is not limited to the lamination structure as shown in FIG. 1. For example, it is possible to eliminate one of the lower elastic layer 6 and the upper elastic layer 7, or both of them. As shown in the modified example of FIG. 10, a thin flexible synthetic resin sheet 61 can be used in place of the lower elastic layer 7. The thin synthetic resin sheet 61 can be, for example, a vinyl-chloride resin sheet, a polyethylene resin sheet, and the like, having a thickness of about 1 to 3 mm.

Furthermore, it can be configured such that the upper elastic layer 7 is omitted and the fiber mat 5 is directly disposed on the air mat 4, or a thin synthetic resin sheet as mentioned above can be disposed therebetween. Alternatively, the synthetic resin low foam sheet used for the aforementioned lower elastic layer 6 can be used for the upper elastic layer 7.

The lamination configuration of the elastic layer on the collective floor substrate 30 can be changed in various manners as long as it includes the air mat and the fiber mat therein.

It should be understood that the terms and expressions used herein are used for explanation and have no intention to be used to construe in a limited manner, do not eliminate any equivalents of features shown and mentioned herein, and allow various modifications falling within the claimed scope of the present invention.

INDUSTRIAL APPLICABILITY

The present invention can be applied to a floor for gymnastic floor exercises in a narrow sense, and also can be applied to a floor for various floor surface exercises such as performances with jumping on a floor surface, such as, e.g., tumbling, aerobics, and cheerleading.

The invention claimed is:

1. A gymnastic floor structure, comprising:

a plurality of elastically supporting leg members to be arranged on a floor surface of a building at predefined intervals;

a plurality of rigid unit floor panels supported by and laid on the plurality of elastically supporting leg members and integrally joined with each other;

a cushioning air mat laid on the plurality of rigid unit floor panels; and a fiber mat laid on the air mat, wherein the cushioning air mat has a linking body having an air space between opposed surfaces of two inner sheets linked by a plurality of linking threads, wherein the linking body is covered by a non-air permeable external sheet to form a mat main body which makes the space air-tight, and wherein the mat main body is provided with a closable air inlet/outlet port for supplying air into or discharging air from the space at a given position of the mat main body.

2. The gymnastic floor structure as recited in claim 1, wherein a lower elastic layer of synthetic resin foam is disposed between the rigid unit floor panel and the cushioning air mat.

3. The gymnastic floor structure as recited in claim 1, wherein the inner sheet of the cushioning air mat is a woven fabric.

4. The gymnastic floor structure as recited in claim 1, wherein a lower elastic layer of synthetic resin foam is disposed between the rigid unit floor panel and the cushioning air mat, and wherein an upper elastic layer of synthetic resin foam is disposed between the cushioning air mat and the fiber mat.

5. The gymnastic floor structure as recited in claim 1, wherein the elastically supporting leg member is a coil spring-type leg member or a synthetic resin foam-type leg member.

6. The gymnastic floor structure as recited in claim 1, wherein the synthetic unit floor panel is a plywood panel.

7. The gymnastic floor structure as recited in claim 3, wherein an upper elastic layer of synthetic resin foam is disposed between the cushioning air mat and the fiber mat.

8. The gymnastic floor structure as recited in claim 1, wherein the linking thread of the cushioning air mat is interwoven into the woven fabric.

9. The gymnastic floor structure as recited in claim 1, wherein a density of the linking threads of the cushioning air mat is 1 to 5 pieces/$cm^2$.

10. The gymnastic floor structure as recited in claim 1, wherein the external sheet of the cushioning air mat is made of urethane resin.

11. The gymnastic floor structure as recited in claim 1, wherein a thickness of the cushioning air mat is 30 to 100 mm.

12. The gymnastic floor structure as recited in claim 1, wherein an air pressure of an inside of the cushioning air mat is set to 10 to 30 kPa.

13. The gymnastic floor structure as recited in claim 1, wherein the fiber mat is made of a cut pile carpet.

14. The gymnastic floor structure as recited in claim 2, wherein the lower elastic layer is formed by a resin foamed member which is 10 to 30 mm in thickness, 6.86 to 9.80 N/$cm^2$ in 25% compression hardness (JIS K6767), and 50 to 60% in repulsive resilience (JIS K6301).

15. The gymnastic floor structure as recited in claim 4, wherein the upper elastic layer is made of a resin foamed member which is 10 to 30 mm in thickness, 6.86 to 9.80 N/$cm^2$ in 25% compression hardness (JIS K6767), and 50 to 60% in repulsive resilience (JIS K6301).

16. The gymnastic floor structure as recited in claim 14, wherein the lower elastic layer is made of a polyolefin resin foamed member or a rubber-modified ethylene vinyl acetate resin foamed member.

17. The gymnastic floor structure as recited in claim 3, wherein the upper elastic layer is made of a resin foamed member which is 20 to 50 mm in thickness, 2.94 to 4.90 N/$cm^2$ in 25% compression hardness (JIS K6767), and 60 to 70% in repulsive resilience (JIS K6301).

18. The gymnastic floor structure as recited in claim 4, wherein the upper elastic layer is made of a resin foamed member which is 20 to 50 mm in thickness, 2.94 to 4.90 N/$cm^2$ in 25% compression hardness (JIS K6767), and 60 to 70% in repulsive resilience (JIS K6301).

19. The gymnastic floor structure as recited in claim 17, wherein the upper elastic layer is made of a polyolefin resin foamed member or a rubber-modified ethylene vinyl acetate resin foamed member.

20. The gymnastic floor structure as recited in claim 2, wherein the elastically supporting leg member is a coil spring-type leg member or a synthetic resin foam-type leg member.

* * * * *